US005297696A

United States Patent [19]

Bernstein et al.

[11] Patent Number: 5,297,696

[45] Date of Patent: Mar. 29, 1994

[54] POUR SPOUT WITH PIERCING INSERT

[75] Inventors: Linda A. Bernstein, Campbell Hall; Robert L. Gordon, Monroe, both of N.Y.

[73] Assignee: International Paper Company, Purchase, N.Y.

[21] Appl. No.: 874,161

[22] Filed: Apr. 27, 1992

[51] Int. Cl.[5] ..... B67D 5/00

[52] U.S. Cl. ..... 222/83; 222/89

[58] Field of Search ..... 222/81, 83, 83.5, 89, 222/5, 541, 522, 525

[56] References Cited

U.S. PATENT DOCUMENTS

| | | | |
|---|---|---|---|
| 2,073,292 | 3/1937 | Waite . | |
| 2,198,564 | 4/1940 | Robison . | |
| 3,406,872 | 10/1968 | Fiquet . | |
| 3,539,076 | 11/1970 | Weiss . | |
| 3,930,286 | 1/1976 | McGowen . | |
| 4,214,675 | 7/1980 | Schmit . | |
| 4,408,700 | 10/1983 | Fillmore et al. | 222/525 |
| 4,483,464 | 11/1984 | Nomura | 222/89 |
| 4,948,015 | 8/1990 | Kawajiri . | |
| 5,016,757 | 5/1991 | Chatourel . | |
| 5,020,690 | 6/1991 | Kishikawa . | |
| 5,027,979 | 7/1991 | Kawajiri . | |
| 5,147,070 | 9/1992 | Iwamoto | 222/541 |

FOREIGN PATENT DOCUMENTS

| | | | |
|---|---|---|---|
| 80/02546 | 11/1980 | World Int. Prop. O. | 222/83 |

*Primary Examiner*—H. Grant Skaggs

[57] ABSTRACT

A container is provided with a pour spout fitment. The fitment carries a flange which secures the fitment to the container, the flange surrounding a dispensing opening in the container. The pour spout is normally externally closed by a screw cap threaded thereon. A frangible membrane normally spans and internally closes the dispensing opening. A hollow piercing insert is positioned within the pour spout lumen, the lower edge of the insert being serrated to define cutting teeth. The screw cap is removed and the piercing element pushed downwardly to thereby rupture the frangible membrane and permit dispensing from the container. The interior of the spout is provided with a plurality of axially spaced, inwardly extending ribs which cooperate with outwardly extending protrusions on the piercing insert to thus define a plurality of discrete axial locations of the piercing insert relative to the spout.

1 Claim, 2 Drawing Sheets

POUR SPOUT WITH PIERCING INSERT

BACKGROUND OF THE INVENTION

This invention relates to dispensing containers for storing and dispensing liquids such as milk, fruit juices, or other potables. Such containers may assume the form of the well-known gable top type milk container wherein access to the contents is obtained by spreading one end of the gable top apart to thereby form a pouring or dispensing spout, after which the spout is re-folded until the next dispensing operation. Such containers may, alternatively, be provided with a pour spout, such as an injection molded plastic spout, having a flange at its bottom and having external screw threads for engagement with a screw on cap. For dispensing, the cap is removed, the container tilted, and all or part of the contents poured out through the pour spout. One example of such a container is shown in U.S. Pat. No. 4,483,464 issued to Nomura.

In a pour spout type container, such as shown in the Nomura patent, it is sometimes desirable to place a seal somewhere axially along the pour spout lumen or passageway, such as across a dispensing opening in the paperboard which forms the carton, with the opening being aligned with the pour spout lumen. In a construction of this type, it is known to employ a piercing insert which the user pushes down after the removal of the external screw cap, so as to rupture a seal or membrane which covers a dispensing opening in one of the container walls. This arrangement permits the contents of the package to be sealed and hence protected against contamination prior to the first use by the consumer. While performing the function of rupturing a seal membrane which covers the dispensing opening, such piercing inserts have not been completely satisfactory, either from a manufacturing point of view or because of difficulties encountered in their use.

SUMMARY OF THE INVENTION

According to the practice of this invention, an injection molded pour spout fitment assembly includes an injection molded piercing insert, with the lower portion of the piercing insert provided with teeth or the like to rupture a sealing membrane which spans and covers a dispensing opening aligned with the lumen or passageway of the pour spout. The piercing element is provided with a central abutment, termed a push button, which the user pushes down to move the piercing element so as to rupture the dispensing opening sealing membrane after the outer cap of the fitment assembly has been removed. The piercing element is in the general form of a hollow cylinder having a plurality of radially extending arms, the radially outmost portion of each of which carries a protrusion. The protrusions are coplanar and are received between radially inwardly extending and axially spaced ribs on the interior of the pour spout. The piercing element is normally positioned such that its protrusions lie between the uppermost and the next uppermost ribs of the pour spout. Upon operation by the consumer, the piercing element is pushed down, with the spout walls moving or deforming so as to allow the piercing insert protrusions to override the second lowermost rib of the pour spout. Motion of the piercing element continues downwardly until the protrusions of the piercing element meet a third radially inwardly extending rib of the pour spout. Still further downward pushing continues, such that the piercing element protrusions pass over this third pour spout rib, causing an audible sound or click, and then the piercing element comes to rest against the top surface of a fourth and bottommost radially inwardly extending rib of the pour spout. This last motion causes the rupture of the sealing frangible membrane across the dispensing opening of the container, with the teeth arrangement being such that the teeth do not completely circumferentially rupture the sealing membrane, so that a portion of the sealing membrane remains intact to prevent it from falling into the container.

The pour spout and piercing element fitment construction of this invention may be applied to one slanting top wall of a conventional gable top type container, or alternatively, may be provided on the top of a brick shaped liquid container, or may be applied to the exterior flat surface of a container of any desired shape.

DETAILED DESCRIPTION OF THE DRAWINGS

Figure 1:
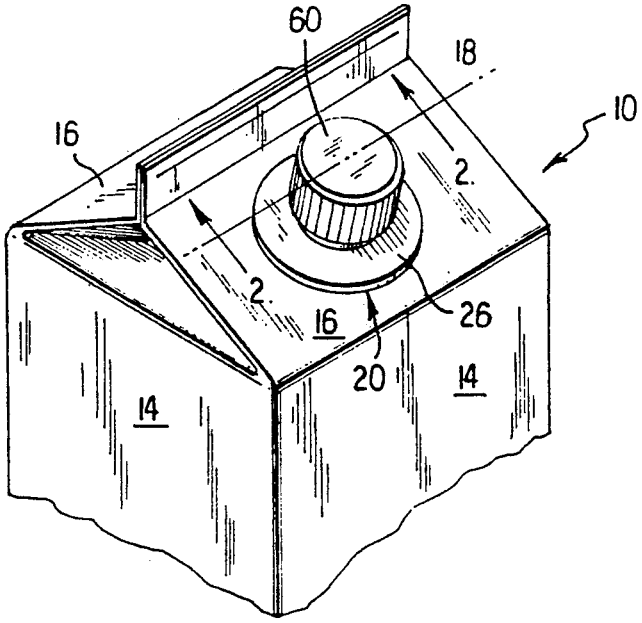
FIG. 1 is a partial perspective view of the upper portion of a gable top type container provided with the pour spout and piercing fitment construction of this invention.

Referring to FIG. 1 of the drawings, the numeral 10 denotes generally a gable top carton having the usual side walls 14 and slanting gable top walls 16, together with the usual upstanding rib or fin 18. An injection molded pour spout fitment assembly is denoted generally as 20 and includes a flange adhesively secured to the exterior of one of the gable walls 16 and a screw cap 60. The pour spout assembly 20 may, typically, be secured to the container by a hot melt or cold glue after the container 10 has been filled with a liquid. Alternatively, the usual plastic extrusion coating on the exterior of the carton walls may be employed as a sealing agent. With the use of an added adhesive such as hot melt or cold glue, a circular bead thereof or a dot pattern is applied to the bottom of flange 26 of the assembly 20 and the fitment placed in registration over a dispensing opening in the carton wall. Adhesive may be applied to the container top as opposed to the bottom of flange 26. The fitment may be applied to the container before filling or after filling.

The precise manner of forming the pour spout and piercing insert is not a part of the invention, and may be conveniently carried out as by injection molding, for example, a technique known to workers in this art.

Referring now to FIG. 2–5 of the drawings, the pour spout fitment construction includes a pour spout having a generally cylindrical wall 24 and an integral, lower, and radially outwardly extending flange 26. The exterior of the pour spout is typically provided with threads 28 to receive complementary grooves on cap 60. The lumen or interior passage of the pour spout is provided with four radially inwardly extending ribs, the uppermost rib is denoted as 32 and is at the top of the pour spout. During assembly, the piercing insert is snapped into the spout teeth first from the top. The insert protrusions 48 slide over top most spout rib 32, coming to rest between first and second spout ribs 32 and 34. The next lowest rib is denoted as 34, with the spacing between ribs 32 and 34 being of an axial extent such as to receive protrusions 48 on the piercing element. Spout rib 34 holds the piercing insert teeth 54 above frangible membrane 72 during shipment and handling prior to use. The third and next lowest rib on the interior of the pour spout is designated as 36, with the fourth and lowermost inwardly extending rib denoted as 38. Rib 38 functions as a stop to prevent further downward movement of insert 44.

The axial spacing between ribs 36 and 38 is preferably such that protrusions on the piercing insert may be accommodated therebetween.

Figure 5:
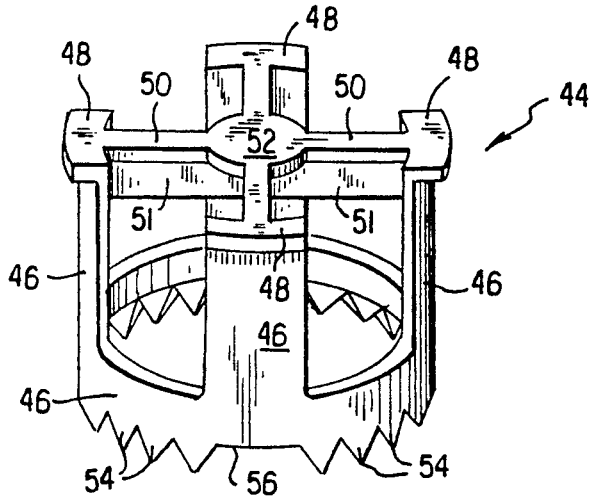
FIG. 5 is a perspective view of the piercing insert.

The piercing insert, shown in perspective at FIG. 5, is denoted as 44 and is generally cylindrical with a plurality of cutouts or side ports 47 in its cylindrical wall 46. Each of a plurality of radially outwardly extending protrusions 48 is integral with a respective portion of the cylindrical wall 46 and also with a respective radially extending arm 50, the radially innermost portions of arms 50 meeting in an abutment or push button 52. Each arm 50 preferably carries, as for reinforcement, a vertically extending section 51 to thus enhance arm rigidity openings or spaces between arms 50 permit axial flow of a liquid through cylindrical piercing element 44. The lower circumferential edge of piercing insert 44 is provided with a plurality of downwardly extending teeth 54, circumferentially continuous except for a gap denoted as 56 which has no teeth.

Figure 2:
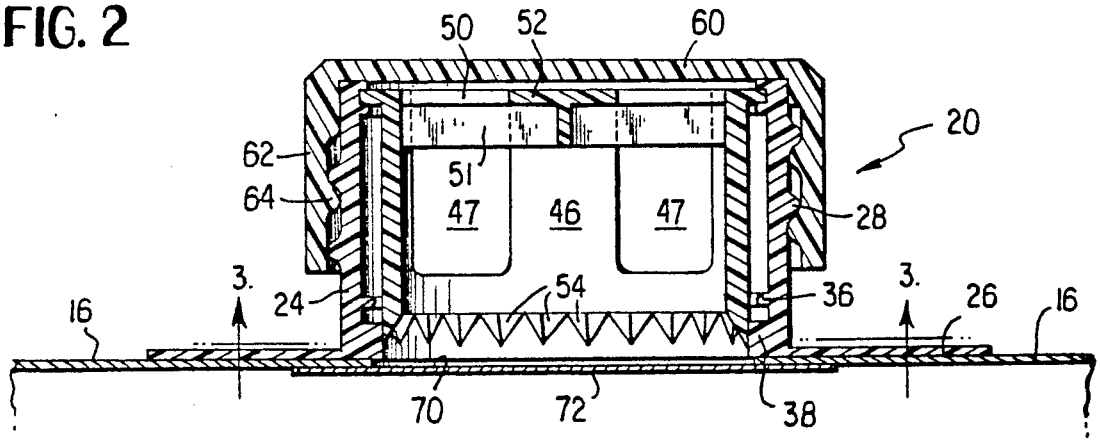
FIG. 2 is a view taken along section 2—2 of FIG. 1.
Figure 3:
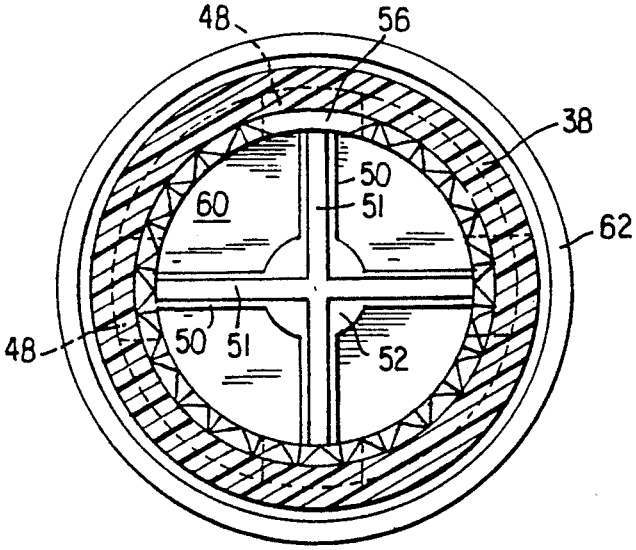
FIG. 3 is a view taken along section 3—3 of FIG. 2.

As illustrated at FIG. 2, one gable top wall 16 is provided with a dispensing opening 70, typically formed with the formation of the blank for forming the carton. A frangible sealing membrane 72, such as a metal foil or the like, is stretched across and closes dispensing opening 70. Alternatively, membrane or seal 72 may also be formed with the blank at the time of blank fabrication and may cover the entire interior surface of the carton. The membrane may also be of plastic material.

Figure 4:
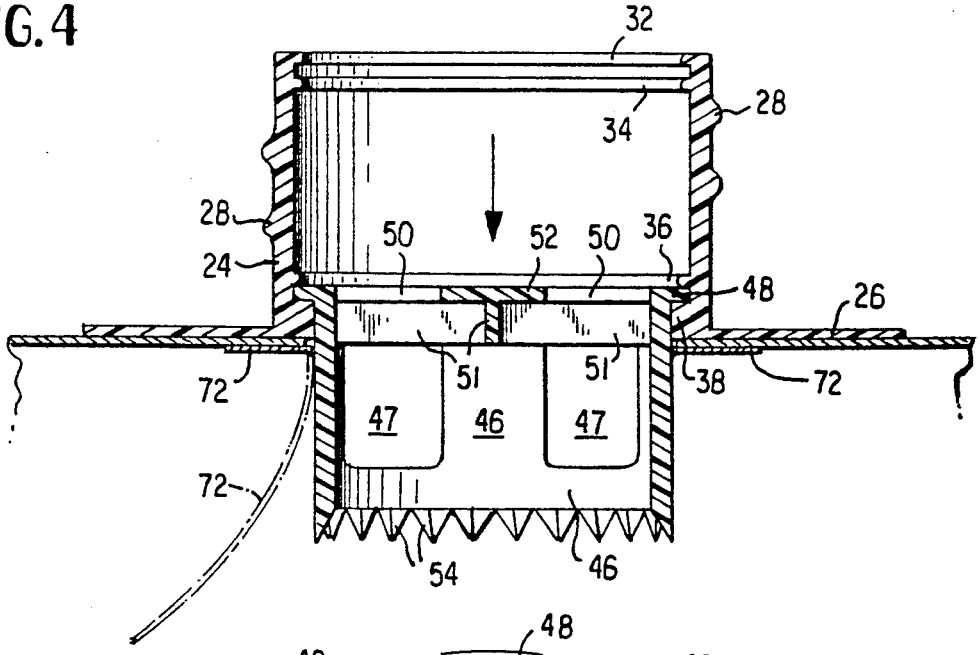
FIG. 4 is a view similar to FIG. 2, and illustrates the extreme lowermost position of the piercing insert relative to the spout, after the cap of the pour spout has been removed.

In operation, considering firstly FIG. 2, the user unscrews cap 60, the latter provided with side walls 62 and grooves 64 for receiving the threads on the pour spout, to thus expose the top of piercing insert 44. A thumb of the user pushes down on abutment 52. Protrusions 48 and ribs 34 and 36 are formed such that there is relative radial movement or deformation to permit protrusions 48 to pass over ribs 34 and 36, and to come into final resting engagement with stop rib 38 of the pour spout. In passing from above rib 36 to the position shown at FIG. 4, there is an audible click or snap, thus indicating to the user that further pushing is not necessary. Teeth 54 of piercing insert 44 rupture frangible seal 72 to thereby permit dispensing all or a portion of the contents of carton 10. The liquid contents may flow both through the lower, open portion of piercing insert 44 and also through openings 47 in the wall thereof. Because teeth 54 are discontinuous at region 56, a portion of membrane 72 remains intact, as indicated at FIG. 4, so that the membrane does not fall into the interior of the carton. This is indicated by the phantom lines 72 of FIG. 4, which are displaced 90 degrees from the front of piercing element region 56 for purposes of illustration.

After partial dispensing of the contents, the cap 60 is replaced on the pour spout and the container is now ready for the next dispensing operation.

Figure 6:
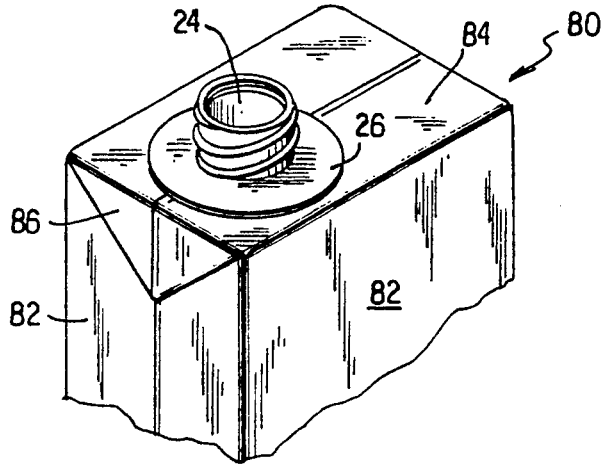
FIG. 6 is a partial perspective view of the uppermost portion of a brick shaped carton provided with the pour spout fitment construction of this invention.

As shown at FIG. 6, the pour spout may be attached to a brick type paperboard container 80 having sidewalls 82, a top wall 84 and at least one bent over flap 86, with a dispensing opening (not illustrated) being provided in top wall 84, similar to dispensing opening 70. The piercing insert is all the way down and activated for pouring of the product. Thus, it is not seen here.

Preferably, flange 26 of the pour spout is thin, formed of a flexible material, to thereby permit it to conform to a flexible package surface or wall. This flexibility permits the fitment to remain attached to the container without breaking or tearing away during distribution or handling. Should the container become dented or crushed, the fitment will still function.

It will be noted that the four side flow ports 47 function to permit delivery of the product should the lower central opening of the piercing insert be clogged or stopped by the seal membrane 72.

It will also be observed that the fitment assembly need not be angularly oriented for application to the container in order for the fitment to function for opening and pouring. It is also not necessary to orient the piercing insert in a specific angular relation to the pour spout in order to assemble these parts.

As noted above, the fitment can be attached to containers after the containers have been filled, no further modification of the container being required with the fitment assembly of this invention. The use of a separate adhesive for placing the fitment on filled containers permits a larger pour spout opening than usually would be required in the case of ultrasonic sealing, since allowance for a large flange sealing area is not required. However, it would be understood that sonic sealing may be employed.

We claim:

1. A pour spout fitment construction including a pour spout having an upper and a lower portion, a flange integrally secured to said spout lower portion, said pour spout having an interior passage, said interior passage having at least three integral, radially inwardly extending ribs axially spaced along said passage to thereby define three vertically disposed ribs, including an uppermost and a lowermost rib, a hollow, annular piercing insert slidably mounted within said spout interior passage, said piercing insert having an upper and a lower portion, said upper piercing insert portion having at least one integral, radially outwardly extending protrusion, said protrusion positioned between the uppermost and the next uppermost of said ribs of said spout, the lower portion of said piercing insert having teeth which project downwardly, said pour spout ribs normally selectably engagable with said at least one insert protrusion to normally prevent axial movement of said insert within said spout, at least one of (A) said at least one piercing insert protrusion and (B) said uppermost spout rib and said spout ribs between said uppermost and said lowermost spout ribs, being radially movable, to thereby permit said at least one piercing insert protrusion to pass over said uppermost spout rib and said spout ribs which are located between said uppermost and said lowermost spout ribs, whereby said piercing insert can assume a plurality of normal axial positions in said pour spout, said piercing insert carries a pushing abutment, said abutment radially located substantially centrally of said pour spout passageway wherein said pushing abutment is integral with a plurality of angularly spaced, radially extending arms, the radially outermost portion of at least one of said arms provided with said at least one insert protrusion.

* * * * *